US005843370A

United States Patent [19]

Koyama et al.

[11] Patent Number: 5,843,370

[45] Date of Patent: Dec. 1, 1998

[54] FERRITIC STAINLESS STEEL FOR EXHAUST SYSTEM EQUIPMENT OF VEHICLE

[75] Inventors: Yuji Koyama; Akihiko Takahashi; Tetsuya Shimada, all of Kitakyushu; Nobuhiro Fujita, Tokyo; Shigeru Maeda, Futtsu, all of Japan

[73] Assignee: Nippon Steel Corporation, Tokyo, Japan

[21] Appl. No.: 945,616

[22] PCT Filed: Mar. 12, 1997

[86] PCT No.: PCT/JP97/00786

§ 371 Date: Oct. 29, 1997

§ 102(e) Date: Oct. 29, 1997

[87] PCT Pub. No.: WO97/34020

PCT Pub. Date: Sep. 18, 1997

[30] Foreign Application Priority Data

Mar. 15, 1996 [JP] Japan ..... 8-059731

[51] Int. Cl.[6] ..... C22C 38/26; C22C 38/28

[52] U.S. Cl. ..... 420/72; 148/325

[58] Field of Search ..... 420/70; 148/325

[56] References Cited

U.S. PATENT DOCUMENTS 4,964,926 10/1990 Hill ..... 148/325

5,685,923 11/1997 Takata et al. ..... 148/325

*Primary Examiner*—Deborah Yee

*Attorney, Agent, or Firm*—Kenyon & Kenyon

[57] ABSTRACT

A ferritic stainless steel consisting essentially of, in terms of weight %, not greater than 0.005% of C, not greater than 0.008% of N with the proviso that the sum of C and N is not greater than 0.009%, not greater than 0.45% of Si, not greater than 1% of Mn, 10 to 12.5% of Cr, 0.05 to 0.3% of Nb, 8×(C+N) to 0.3% of Ti, and the balance consisting of Fe and unavoidable impurities is produced. A ferritic stainless steel for use in exhaust system equipment for cars, which can be produced at a low finish annealing temperature and is excellent in both formability at an ordinary temperature and in high temperature strength, can be provided.

2 Claims, 2 Drawing Sheets

FERRITIC STAINLESS STEEL FOR EXHAUST SYSTEM EQUIPMENT OF VEHICLE

TECHNICAL FIELD

This invention relates to a ferritic stainless steel having excellent formability at an ordinary temperature and excellent strength at a high temperature for use in exhaust system equipment for cars.

BACKGROUND ART

In current production cars, the exhaust gas temperature has become higher and higher with higher output and higher performance of the engines, and a further improvement in high temperature strength has been required in the steel materials for the exhaust gas system equipment for the cars.

As technologies for improving the high temperature strength by adding Nb to a ferritic stainless steel so as to satisfy the requirements described above, Japanese Unexamined Patent Publication (Kokai) No. 3-294417, for example, discloses a technology which anneals a ferritic stainless steel having C and N contents of not greater than 0.03% and containing 0.1 to 1% of Nb added thereto at a temperature within the range of 1,100 to 1,250° C., and Japanese Unexamined Patent Publication (Kokai) No. 5-331551 discloses a method which conducts finish annealing of a ferritic stainless steel having a C content of not greater than 0.02% and an N content of not greater than 0.03% and containing 0.4 to 1% of Nb added thereto at a temperature within the range of 1,100 to 1,200° C. As disclosed in these prior art technologies, a greater quantity of Nb is required to obtain a high temperature strength in the relatively high C and N contents, so that the recrystallization temperature becomes excessively high and annealing must be carried out at a high temperature exceeding 1,100° C.

On the other hand, a ferritic stainless steel for use in exhaust system equipment is described, for example, in Japanese Unexamined Patent Publication (Kokai) No. 6-248394. This reference describes a steel which contains Cr in a specific range, limits Nb and Ti as stabilization elements in specific ranges besides C and N, and supplementarily adds Si, Mo and Ni to improve a high temperature salt water corrosion resistance of a blank as a technology for improving an intergranular corrosion resistance of a welding heat affected zone of a front pipe, a center pipe, etc, of the car. However, because this reference adds large quantities of Si, Nb and Mo, it is not free from the problems that the recrystallization temperature of the steel becomes higher and the high temperature finish annealing requires in addition to a deterioration of formability at the ordinary temperature. In Japanese Unexamined Patent Publication (Kokai) No. 6-184705 developed for the same purpose as the reference described above and Japanese Unexamined Patent Publication (Kokai) No. 3-264652 describing an exhaust gas muffler material, on the other hand, the C+N value is limited to a low value by adding Nb and Ti. Because large quantities of Nb are added and the C+N value which still remains at a high level, however, the same problems as those of the prior art technologies described above occur.

U.S. Pat. No. 4,834,808 discloses a ferritic stainless steel for use in exhaust system equipment of cars. Though this patent uses Nb and Ti in combination, it cannot secure a low C+N value because the steel contains a high N content. In consequence, the problems that the solid solution Nb quantity decreases because of a small amount of Nb addition and the high temperature strength is deteriorated remain unsolved. Further, U.S. Pat. No. 4,964,926 shows no technical concept of increasing the solid solution Nb quantity by keeping a low C+N content, though the steel of this patent has a high Si content in order to secure the high temperature strength.

A YUS450-MS steel (Japanese Unexamined Patent Publication (Kokai) No. 5-821356) is commercially available on the market as an exhaust system material, for cars, having an improved high temperature strength. This material has a component composition containing 1% of Mo which is added in addition to 14% of Cr, 0.020% of C+N, 0.1% of Ti and 0.3% of Nb. This technology adds Nb in order to improve the high temperature strength, it is true, but is rather directed to achieve the solid solution effect of Nb and Mo by adding Mo and to secure the solid solution Nb quantity by controlling the form of the precipitate of Nb carbonitrides. When Nb is alone added, $Fe_3Nb_3C$ which is likely to grow to coarse particle precipitates. (This means that three Nb are consumed per C atom). When Ti is compositely added, on the other hand, the form of the precipitate changes to a (Ti, Nb)C type, and the drop of the solid solution Nb quantity when the steel is kept at a high temperature for a long time can be restricted. Furthermore, Mo, which does not form the C and N compounds, is added so as not to form the C and N compounds and to improve the high temperature strength in the environment of the car exhaust system by effectively utilizing solid solution Mo. In this sense, this technology is novel. However, because the steel contains large quantities of Cr and Mo, the steel is not free from the greatest problem that formability at the ordinary temperature becomes inferior. In addition, because the cost of the alloy is high, the steel lacks versatility.

Besides the patents described above, there are a large number of patents directed to a ferritic stainless steel for use in exhaust system equipment for cars, but a ferritic stainless steel used for the exhaust system equipment for cars which does not use an expensive element such as Mo, has a low Si content besides the ultra-low C+N content, compositely adds Nb and Ti, satisfies a good balance of components on the basis of the optimum component design, has excellent high temperature strength and formability at the ordinary temperature and is moreover economical, has not yet been known.

In order to obtain excellent formability at an ordinary temperature, the metallic structure must be completely recrystallized. When Nb is added to improve the high temperature strength, the recrystallization temperature of the steel rises. As a result, to obtain excellent formability at the ordinary temperature and high temperature strength of the steel, the annealing temperature for recrystallization must be set to a high level, and such a high annealing temperature results in an increase in energy consumption and in an increase in production cost.

DISCLOSURE OF THE INVENTION

The inventors of the present invention have conducted detailed studies on the steel compositions which increase the solid solution Nb quantity so as to improve the high temperature strength at a small Nb addition quantity without much increasing the recrystallization temperature. As a result, the present inventors have found that the solid solution Nb quantity necessary for improving the high temperature strength can be secured by inhibiting the formation of Nb carbonitrides even in the small Nb addition quantity by limiting the C and N contents to ultra-low contents and by fixing them by Ti which is further added compositely.

When a steel to which Nb is alone added and a steel to which Nb and Ti are added are compared to the ferritic stainless steels used for the exhaust system equipment of cars, the solid solution Nb quantity in the Nb-Ti steel is greater even in the same addition Nb quantity than in the Nb steel, and the reason is presumably because formation free energy of TiC is smaller than that of NbC. in other words, when Ti and Nb are compositely added, C preferentially combines with Ti, so that Nb does not often combine with C, and the solid solution Nb quantity becomes greater in the case of the composite addition in the same Nb addition quantity.

As to the change of the structure due to aging, carbonitrides having a particle size of 0.2 to 0.5 $\mu$m and those having the Laves phase at the time of annealing change to coarse $M_6C$ after aging as in the case of the Nb addition alone. When Ti is compositely added, on the other hand, precipitation of the MC type carbonitrides, i.e. (Ti, Nb)(C, N), can be recognized under the annealed state, and precipitation of the coarse $M_6C$, which has been observed in the case of the Nb addition alone, is not recognized after aging, though (Ti, Nb)(C, N) and the Laves phase can be recognized. In other words, precipitation of the coarse $M_6C$ can be restricted by compositely adding Ti, and the solid solution Nb quantity increases.

The present invention is based on the technical concept, described above, that C is fixed by Ti by compositely adding Nb-Ti so as to secure necessary solid solution Nb and to accomplish the high strength, and the gist of the present invention resides in the following points.

Namely, the gist of the invention resides in a ferritic stainless steel for use in exhaust system equipment for cars which contains, in terms of weight %, not greater than 0.005% of C, not greater than 0.008% of N with the sum of C and N being not greater than 0.009%, not greater than 0.45% of Si, not greater than 1.0% of Mn, 10 to 12.5% of Cr, 0.05 to 0.3% of Nb, 8×(C+N) to 0.3% of Ti and the balance consisting of Fe and unavoidable impurities. In the steel composition described above, Nb may be from 0.05 to 0.25%.

Hereinafter, the reasons for limitation of the components will be explained.

C: The C content must be not greater than 0.005%. When the steel contains C in a quantity exceeding 0.005%, formability of the steel at the ordinary temperature is deteriorated, the solid solution Nb quantity decreases, and the improvement in the high temperature strength is impeded.

N: The N content must be limited to not greater than 0.008%. When the steel contains N in a quantity exceeding 0.008%, formability of the steel at an ordinary temperature is deteriorated, and the decrease of the solid solution Nb quantity occurs.

In addition to the limitation of the C and N contents to the respective ranges described above, the sum of C and N must be limited to not greater than 0.009%. Though the present invention fixes C and N by adding Ti, the Ti addition quantity increases and the decrease of the solid solution Nb quantity occurs when the sum of C and N exceeds 0.009%.

According to the present invention, it is particularly necessary to limit C to not greater than 0.005%, N to not greater than 0.008% and furthermore, C+N to not greater than 0.009%. When the C and N contents are large, elongation of the steel becomes small and formability at an ordinary temperature is deteriorated. The present invention fixes C and N in the form of Ti(C, N) by adding Ti in the quantity corresponding to the C+N quantity so as to mitigate deterioration of formability. When C and N are contained in large quantities, the addition quantity of expensive Ti becomes correspondingly great and furthermore, since the precipitation quantity of Ti(C, N) becomes great, formability at the ordinary temperature is deteriorated.

The necessity of reducing the C and N contents from the aspect of the high temperature strength will be discussed. First of all, all of N is not always combined with Ti in the form of TiN but a part of it combines with Nb in the form of NbN. As a result, the solid solution Nb content decreases and the high temperature strength deteriorates. Large quantities of expensive Nb must be added to make up for this determination, and because the recrystallization temperature rises, finish annealing at a high temperature becomes essentially necessary. As to C, a part of C combines with Nb in the form of $Fe_3Nb_3C$, and because this precipitate consumes three Nb per C, it greatly decreases the solid solution Nb quantity.

For these reasons, the C and N contents must be reduced. Particularly because C forms the precipitate having the form of $Fe_3Nb_3C$, C must be reduced more greatly than N.

This discussion will be explained in further detail with reference to FIGS. 1 and 2. FIG. 1 shows the measurement result when the solid solution Nb quantity was measured for each of 10.8% Cr—0.25% Nb—0.0020% C—0.0080% N steel (① steel) and a steel obtained by further adding compositely 0.15% of Ti with Nb to this component composition (② steel) was kept at 900° C. As can be seen clearly from FIG. 1, the steel compositely containing Nb and Ti (② steel) exhibits a clear difference of the solid solution Nb quantity from the steel containing Nb alone (① steel) when kept at 900° C. around the exhaust gas environment for a long time, and the composite addition of Nb and Ti was found effective.

FIG. 2 shows the result of the relationship between the C+N content and the solid solution Nb quantity. The steel used for this experiment was a 10.8% Cr—0.25% Nb—10×(C %+N %)Ti % steel, and the result of the measurement of the solid solution Nb quantity when this steel was kept at 900° C. for 100 hours was shown in the diagram. Table 1 tabulates the values (weight %) read from FIG. 2.

TABLE 1

| C +N quantity | 0.004 | 0.006 | 0.008 | 0.009 | 0.01 | 0.015 | 0.022 |
|---|---|---|---|---|---|---|---|
| solid solution Nb quantity | 0.226 | 0.225 | 0.222 | 0.218 | 0.198 | 0.19 | 0.18 |

It can be clearly understood from FIG. 2 and Table 1 that the solid solution Nb quantity increases when the C+N quantity is decreased, and drastically increases particularly when the C +N quantity becomes smaller than 0.0090%. The reason is presumably because the most of C combines with Ti in the form of TiC and hardly any C remains which can combine with Nb when the C+N quantity becomes not greater than 0.0090%.

Si: The Si content must be limited to not greater than 0.45%.

Since Si is added as a deoxidizing material, a certain Si content is unavoidable, but when the Si content exceeds 0.45%, formability of the steel at the ordinary temperature is extremely deteriorated.

Mn: The Mn content must be limited to not greater than 1%.

Mn is an effective element for deoxidation in the same way as Si. When a large quantity of Mn exceeding 1% is contained, however, the MnS formation quantity increases and the corrosion resistance of the steel decreases. Nonetheless, the addition of Mn in a quantity exceeding 0.5% is effective for forming a compact oxide scale. When it is necessary to restrict the peel of the oxide scale formed during the use of the steel at a high temperature, Mn is preferably added in a quantity greater than 0.5%.

Cr: The Cr content must be limited to not smaller than 10% but not greater than 12.5%.

Cr is one of the basic elements of the stainless steel, and at least 10% of Cr must be added to obtain an excellent corrosion resistance. When the Cr content exceeds 12.5%, however, the formability of the steel at an ordinary temperature, which is one of the primary objects of the present steel, deteriorates. From the aspect of the corrosion resistance, too, the Cr content of 12.5% is a sufficient quantity to satisfy the required corrosion resistance, and a greater quantity increases the cost of the alloy.

Ti: The Ti content must be at least 8 times the C+N content and must be limited to not greater than 0.3%.

To fix C and N in the form of Ti(C, N) and to improve the formability at the ordinary temperature moldability, Ti must be added in the quantity at least eight times the C+N content. When C and N are fixed in this form, the solid solution Nb quantity effective for improving the high temperature strength can be increased. Further, when Ti is compositely added with Nb, the formation of the $Fe_3Nb_3C$ type precipitate, which grows to coarse particles during the use of the steel at a high temperature and greatly decreases the solid solution Nb quantity, can be inhibited and can be converted to a fine (Nb, Ti)(C, N) type. However, the Ti addition quantity of 0.3% can sufficiently accomplish fixing of C and N and control of the form of the precipitate during the use at the high temperature, and the addition of Ti in a greater quantity results in the occurrence of cracks and scratches during hot rolling and invites the rise of the production cost. Therefore, the upper limit must be 0.3%.

Nb: The Nb content must be limited to at least 0.05 but less than 0.30%.

In order to improve the formability at ordinary temperature, the Cr content as one of the effective elements for improving the high temperature strength is reduced in the steel of the present invention. Therefore, the solid solution Nb quantity is the most important element for improving the high temperature strength, and unless the Nb content is at least 0.05%, no effect can be obtained. However, the recrystallization temperature of the steel remarkably increases with the increasing Nb content, and to prevent the formability at the ordinary temperature by recrystallizing the metallic structure of the steel, finish annealing at a high temperature becomes necessary. This finish annealing at a high temperature increases the consumption quantity of energy, exerts adverse influences on the earth environment and increases the production cost. FIG. 3 shows the results of the recrystallization temperature of a steel containing 0.002% of C, 0.40% of Si, 0.40% of Mn, 10.8% of Cr, 0.15% of Ti and 0.006% of N when the Nb content was further changed from 0.05% to 0.35%. It can be understood from FIG. 3 that in order to limit the recrystallization temperature to a low temperature and to recrystallize the steel at a low finish annealing temperature, the Nb content must be less than 0.30%. When it is necessary to produce the steel sheet at a lower recrystallization temperature, that is, at a low finish annealing temperature, the Nb content must be Limited to not greater than 0.25%.

BEST MODE FOR CARRYING OUT THE INVENTION

EXAMPLE 1

Figure 1:
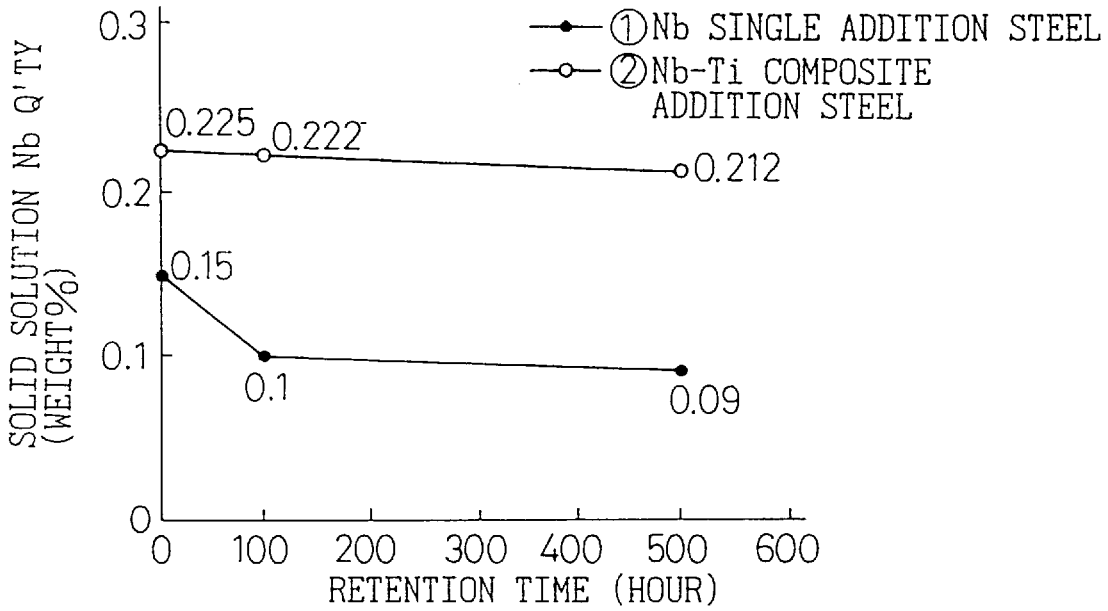
FIG. 1 shows the result of measurement of a solid solution Nb quantity when each of a Nb addition steel and a Nb-Ti composite addition steel is kept at 900° C.
Figure 2:
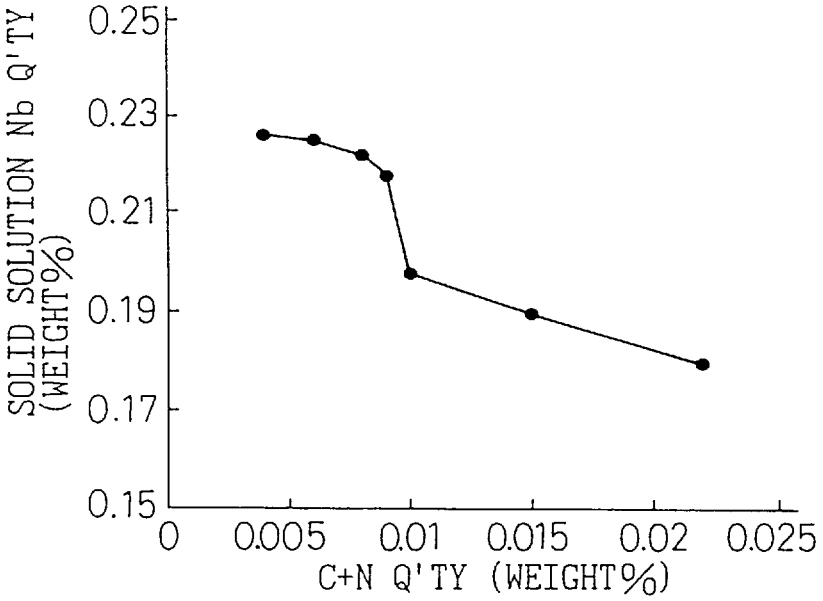
FIG. 2 shows the result of measurement of a C +N quantity and a solid solution Nb quantity when a Nb-Ti composite addition steel is kept at 900° C. for 100 hours.
Figure 3:
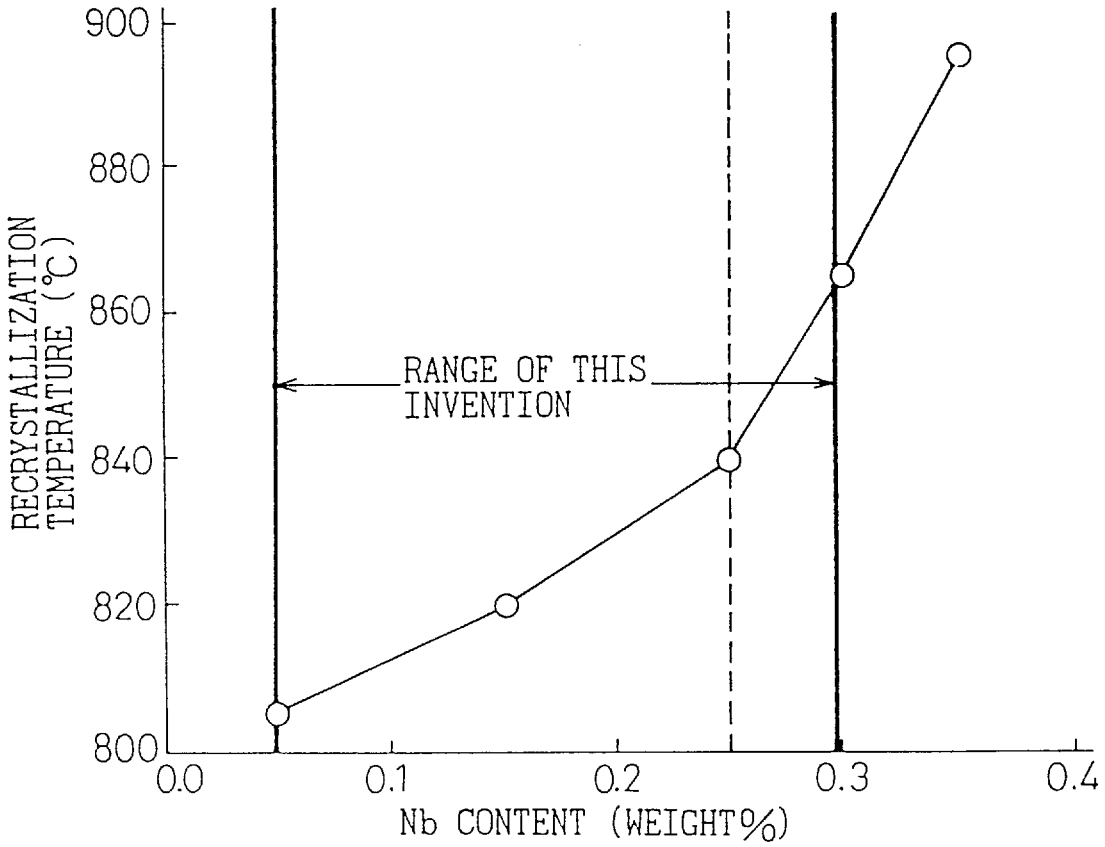
FIG. 3 shows the relation between a Nb content and a recrystallization temperature that affects a low C+N—10.8% Cr—0.15% Ti steel.

Ten kinds of steels A to J having the components tabulated in Table 2 were molten in a vacuum melting furnace and were then cast. Each of the cast slabs was hot rolled and then cold rolled into a 1.5 mm-thick steel sheet, and was thereafter finish annealed at a recrystallization temperature +25° C. tabulated in the table.

Table 3 illustrates elongation at break (%) at an ordinary temperature as an index of formability at the ordinary temperature and 0.2% yield strength (MPa) at 900° C. as an index of high temperature strength.

The steels A to D having the compositions within the range of the present invention had excellent elongation at ordinary temperature and excellent strength at high temperature. Furthermore, because their recrystallization temperature was low, finish annealing could be made at a low temperature.

Elongation at break at ordinary temperature was small for the steels E and I because the Si contents in E, and the Cr contents in I exceeded the ranges of the present invention.

Both of the (C+N) content and the C content were greater than the range of the present invention in the steels F and G, and their high temperature strength dropped greatly in comparison with the steel A having a similar Nb addition quantity (0.25%) and was smaller even that of the steel D having a Nb addition quantity of 0.15%. Because the Nb addition quantity was smaller than the range of the present invention in the steel H, the effect of the addition of Nb did not appear in the high temperature strength.

Since the Ti addition amount was smaller in the steel J than the range of the present invention, C and N could not be fixed sufficiently by Ti, so that elongation at break at the ordinary temperature and the high temperature strength were small.

TABLE 2

| | (weight %) | | | | | | | | | |
|---|---|---|---|---|---|---|---|---|---|---|
| steel | C | Si | Mn | Cr | Nb | Ti | N | C + N | recrystallization temp. | remarks |
| A | 0.0020 | 0.41 | 0.55 | 10.8 | 0.25 | 0.15 | 0.0060 | 0.0080 | 840° C. | Steel of this |
| B | 0.0040 | 0.40 | 0.52 | 10.8 | 0.28 | 0.15 | 0.0040 | 0.0080 | 855 | Invention |

TABLE 2-continued

| steel | C | Si | Mn | Cr | Nb | Ti | N | C + N | recrystallization temp. | remarks |
|---|---|---|---|---|---|---|---|---|---|---|
| | (weight %) | | | | | | | | | |
| C | 0.0020 | 0.40 | 0.52 | 10.8 | 0.21 | 0.14 | 0.0060 | 0.0080 | 830 | |
| D | 0.0020 | 0.41 | 0.53 | 10.9 | 0.15 | 0.15 | 0.0060 | 0.0080 | 820 | |
| E | 0.0020 | 0.60 | 0.55 | 10.8 | 0.25 | 0.15 | 0.0060 | 0.0080 | 840° C. | Comparative Steel |
| F | 0.0045 | 0.40 | 0.52 | 10.9 | 0.24 | 0.15 | 0.0070 | 0.0115 | 838 | |
| G | 0.0065 | 0.40 | 0.53 | 10.8 | 0.25 | 0.15 | 0.0020 | 0.0085 | 840 | |
| H | 0.0020 | 0.40 | 0.55 | 10.8 | 0.02 | 0.15 | 0.0060 | 0.0080 | 800 | |
| I | 0.0020 | 0.35 | 0.55 | 13.5 | 0.25 | 0.15 | 0.0060 | 0.0080 | 840 | |
| J | 0.0020 | 0.41 | 0.53 | 10.8 | 0.25 | 0.03 | 0.0060 | 0.0080 | 840 | |

TABLE 3

| steel | elongation at break (%) | 0.2% yield strength at 900° C. (MPa) | remarks |
|---|---|---|---|
| A | 37.0 | 18.8 | Steel of this |
| B | 36.8 | 19.0 | Invention |
| C | 31.1 | 17.5 | |
| D | 37.1 | 16.9 | |
| E | 33.8 | 18.7 | Comparative |
| F | 35.8 | 16.1 | Steel |
| G | 35.7 | 15.8 | |
| H | 36.1 | 12.0 | |
| I | 33.4 | 19.2 | |
| J | 33.1 | 15.1 | |

INDUSTRIAL APPLICABILITY

The present invention makes it possible to produce a steel having an excellent formability at the ordinary temperature and an excellent high temperature strength without adding large quantities of expensive alloys, at a low finish annealing temperature. As a result, the present invention can reduce the energy consumption quantity and the production cost required for producing a ferritic stainless steel for use in exhaust system equipment for cars, and makes extremely a great contribution to the industry.

We claim:

1. A ferritic stainless steel for use in exhaust system equipment for cars, consisting essentially of, in terms of weight %:

C: not greater than 0.005%,

N: not greater than 0.008% with the proviso that

C+N: not greater than 0.009%,

Si: not greater than 0.45%,

Mn: not greater than 1.0%,

Cr: 10 to 12.5%,

Nb: 0.05 to 0.3%,

Ti: 8×(C+N) to 0.3%, and the balance consisting of Fe and unavoidable impurities.

2. A ferritic stainless steel for use in exhaust system equipment for cars, consisting essentially of, in terms of weight %:

C: not greater than 0.005%,

N: not greater than 0.008% with the proviso that

C+N: not greater than 0.009%,

Si: not greater than 0.45%,

Mn: not greater than 1%,

Cr: 10 to 12.5%,

Nb: 0.05 to 0.25%,

Ti: 8×(C+N) to 0.3%, and the balance consisting of Fe and unavoidable impurities.

* * * * *